US006199998B1

(12) United States Patent
Hsiao

(10) Patent No.: US 6,199,998 B1
(45) Date of Patent: Mar. 13, 2001

(54) DRIVING TOOL WITH ILLUMINATING CAPABILITY

(76) Inventor: Hsuan-Sen Hsiao, No. 15-1, Lane 369, Min-Chuan Rd., Taichung City (TW)

( * ) Notice: Subject to any disclaimer, the term of this patent is extended or adjusted under 35 U.S.C. 154(b) by 0 days.

(21) Appl. No.: 09/307,325

(22) Filed: May 7, 1999

(51) Int. Cl.[7] ..... B25B 23/18
(52) U.S. Cl. ..... 362/119; 362/120; 362/206
(58) Field of Search ..... 362/119, 120, 362/202, 205, 578, 206

(56) References Cited

U.S. PATENT DOCUMENTS

| | | | | |
|---|---|---|---|---|
| 5,515,249 | * | 5/1996 | Shiao | 362/119 |
| 5,579,668 | * | 12/1996 | Kozak | 81/439 |
| 5,713,656 | * | 2/1998 | Lin | 362/119 |
| 5,980,077 | * | 11/1999 | Shiao | 362/578 |
| 6,030,092 | * | 2/2000 | McCalla et al. | 362/119 |
| 6,145,995 | * | 11/2000 | Hung | 362/119 |

* cited by examiner

*Primary Examiner*—Thomas M. Sember
(74) *Attorney, Agent, or Firm*—Sheridan Ross P.C.

(57) ABSTRACT

A driving tool includes a handle, a drive shaft, and a torch. The handle has a tubular outer casing and a transparent front cap mounted integrally and securely on a front end portion of the outer casing so as to establish a watertight seal therewith. The outer casing confines a receiving chamber with a rear opening, and has an internally threaded rear end portion. The drive shaft is fixed to the front cap, and extends forwardly therefrom. The torch is received removably in the receiving chamber, and includes a tubular inner housing, a lamp unit mounted at a front end portion of the inner housing, a push-button switch member mounted on a rear end portion of the inner housing, a tubular rear cap mounted securely on the rear end portion of the inner housing and having an externally threaded front section for engaging threadedly the rear end portion of the outer casing, and an open rear section for access to the switch member, a sealing ring provided on the rear cap to establish a watertight seal between the rear cap and the inner housing, and a resilient sealing member having a central portion which is adjacent to the switch member, and a peripheral portion sealingly retained at the rear section of the rear cap.

4 Claims, 6 Drawing Sheets

DRIVING TOOL WITH ILLUMINATING CAPABILITY

BACKGROUND OF THE INVENTION

1. Field of the Invention

This invention relates to a driving tool, such as a screwdriver, which has an illuminating capability, more particularly to a driving tool which is provided with waterproof means to permit use of the tool in water.

2. Description of the Related Art

Referring to FIG. 1, a first conventional screwdriver 10 is shown to include a hollow handle body 11 formed with a receiving chamber 12, a pair of bulbs 132 mounted on an open front end of the handle body 11, a seater 131 mounted on the front end of the handle body 11 between the bulbs 132 for mounting of a shank 17 thereon, a battery set 14 received in the receiving chamber 12, and a switch member 15 mounted on a rear end of the handle body 10 and connected electrically to the battery set 14 and the bulbs 132. The switch member 15 is depressible to control actuation of the bulbs 132. However, since the screwdriver 10 is not provided with waterproofing means to prevent entry of water or moisture into the receiving chamber 12, it cannot be used in water or under very humid circumstances.

Referring to FIGS. 2 and 3, another conventional screwdriver 20 is shown to include a tubular handle body 21, a front cap 23 mounted on a front end portion of the handle body 21 by means of a retaining sleeve 25 that engages threadedly the front end portion of the handle body 21, a torch 22 received in the handle body 21, and a rear cap 24 mounted threadedly on a rear end portion of the handle body 21 for retaining removably the torch 22 in the handle body 21. The front cap 23 has a shank 231 mounted thereon. The rear cap 24 has a resilient central portion 241 which is depressible to permit actuation of the torch 22. The screwdriver 20 is provided with an illuminating capability, and the torch 22 is removable from the screwdriver 20 for individual use. However, the screwdriver 20 still cannot be used in water or under very humid circumstances since no waterproofing means is provided to prevent entry of water or moisture into the handle body 21.

SUMMARY OF THE INVENTION

Therefore, the object of the present invention is to provide a driving tool that is provided with a removable torch and that is waterproof so as to be operable in water or under very humid circumstances.

Accordingly, the driving tool of the present invention includes a handle, a drive shaft, and a torch. The handle has a tubular outer casing with front and rear end portions, and a transparent front cap mounted integrally and securely on the front end portion of the outer casing so as to establish a watertight seal therewith. The outer casing confines a receiving chamber with a rear opening. The rear end portion of the outer casing is formed with an internal screw thread. The drive shaft is mounted on the front cap, and extends forwardly therefrom. The torch is received removably in the receiving chamber of the handle. The torch includes a tubular inner housing, a lamp unit mounted in the inner housing at a front end portion of the inner housing, a push-button switch member mounted on a rear end portion of the inner housing and associated operably with the lamp unit to control activation of the lamp unit, a tubular rear cap mounted securely on the rear end portion of the inner housing and having an externally threaded front section which extends into the outer casing of the handle via the rear opening for engaging threadedly the rear end portion of the outer casing, and an open rear section for access to the switch member, a sealing ring provided on the rear cap to establish a watertight seal between the rear cap and the inner housing, and a resilient sealing member disposed rearwardly of the switch member and having a central portion disposed adjacent to the switch member, and a peripheral portion sealingly retained at the rear section of the rear cap to establish a watertight seal between the rear cap and the inner housing. The central portion of the sealing member is depressible to permit actuation of the switch member.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
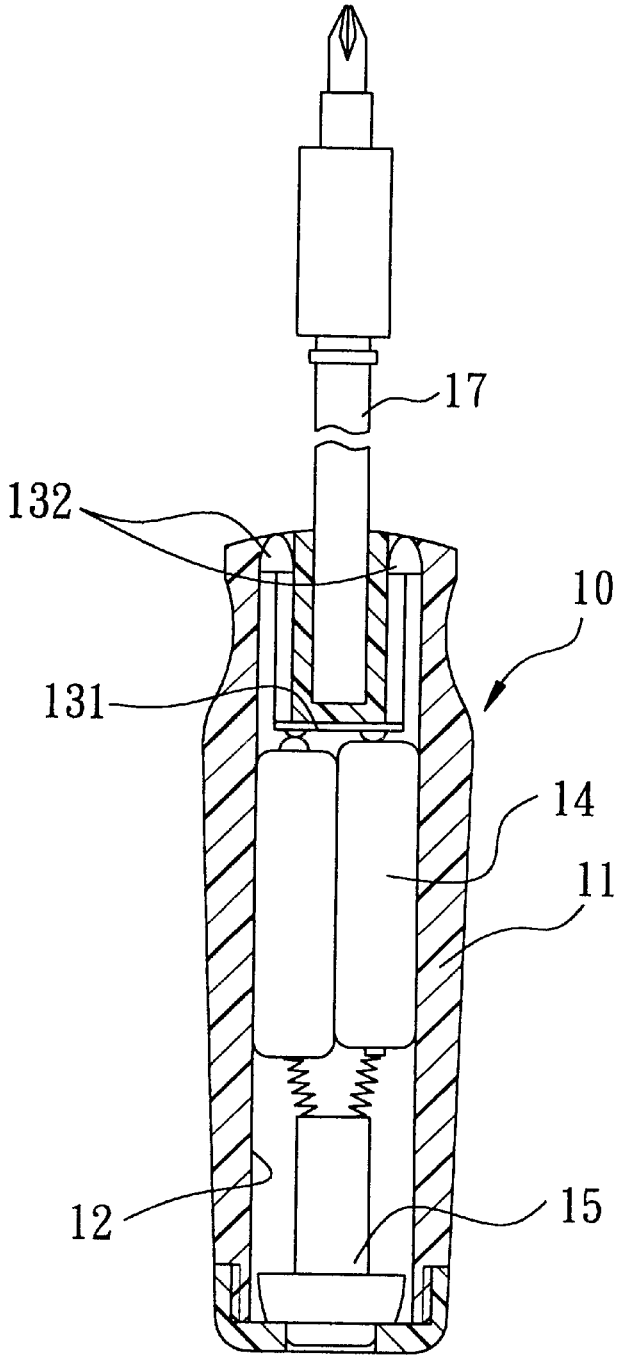
FIG. 1 PRIOR ART
FIG. 1 is a sectional view of a conventional screwdriver.
Figure 2:
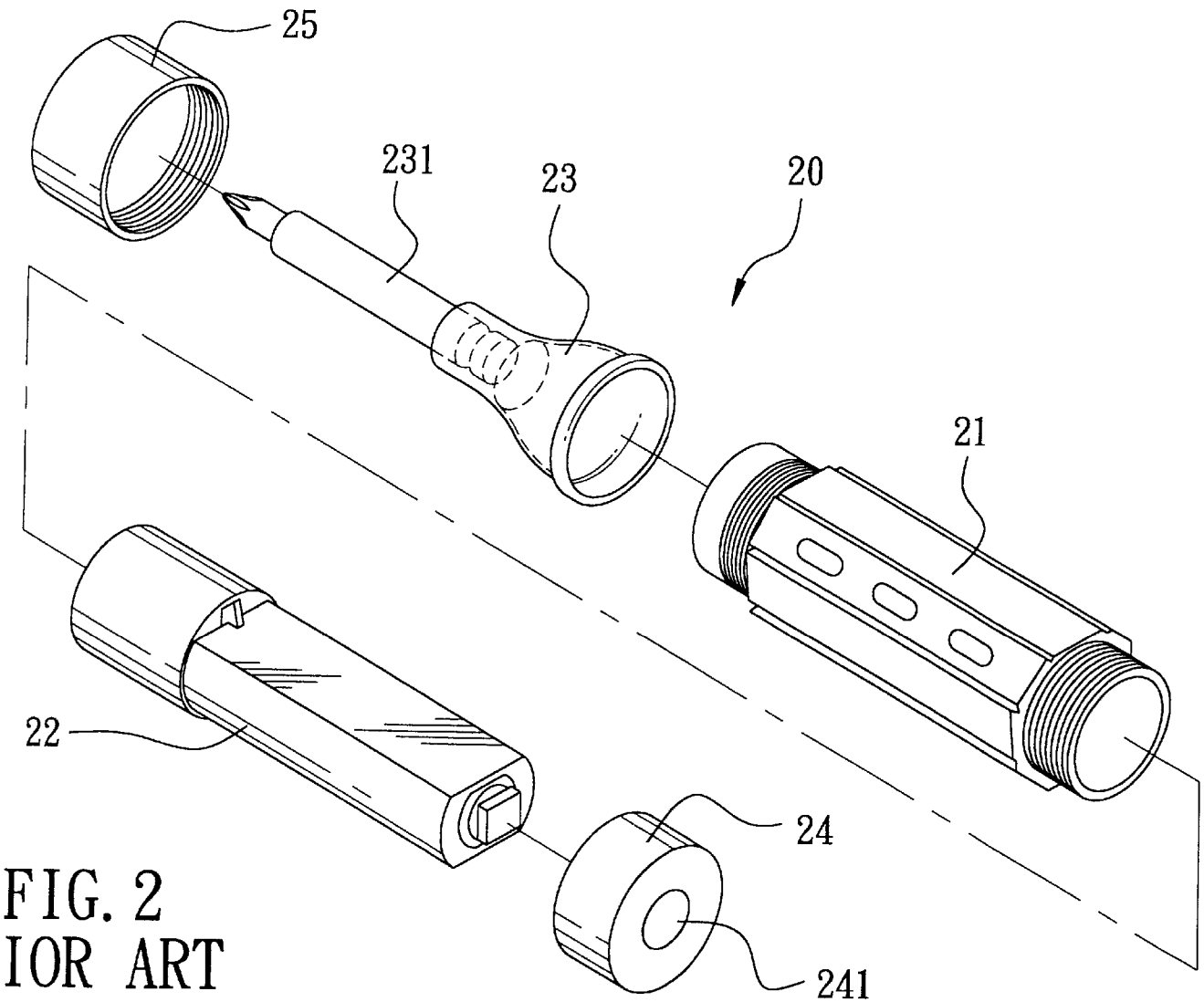
FIG. 2 PRIOR ART
FIG. 2 is an exploded perspective view of another conventional screwdriver.
Figure 3:
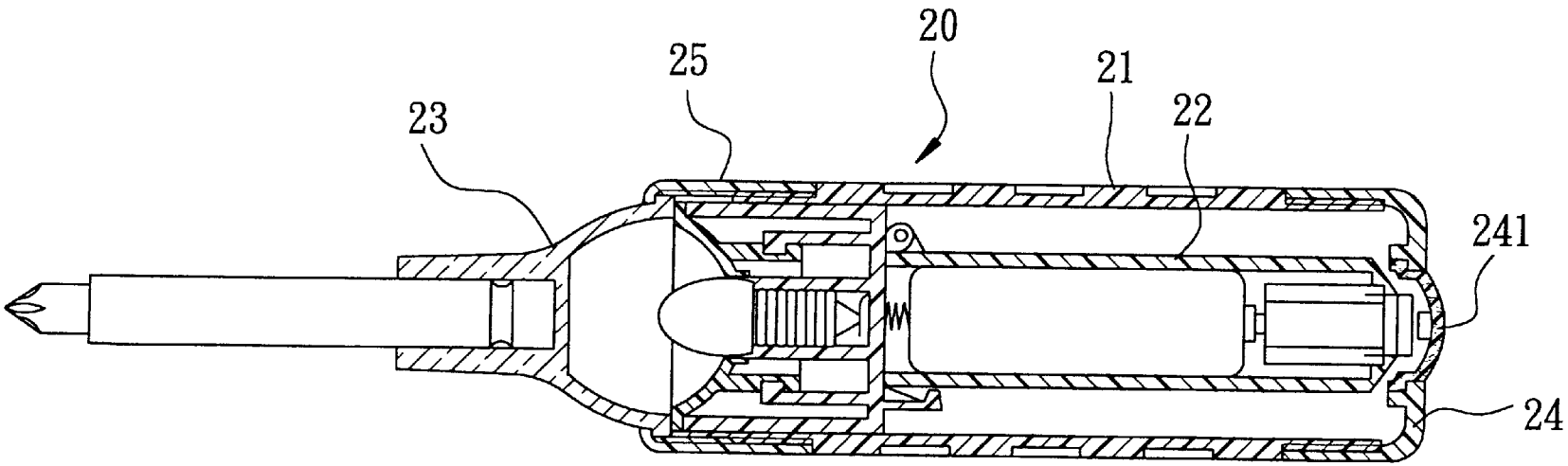
FIG. 3 PRIOR ART
FIG. 3 is a sectional view of the conventional screwdriver of FIG. 2.
Figure 4:
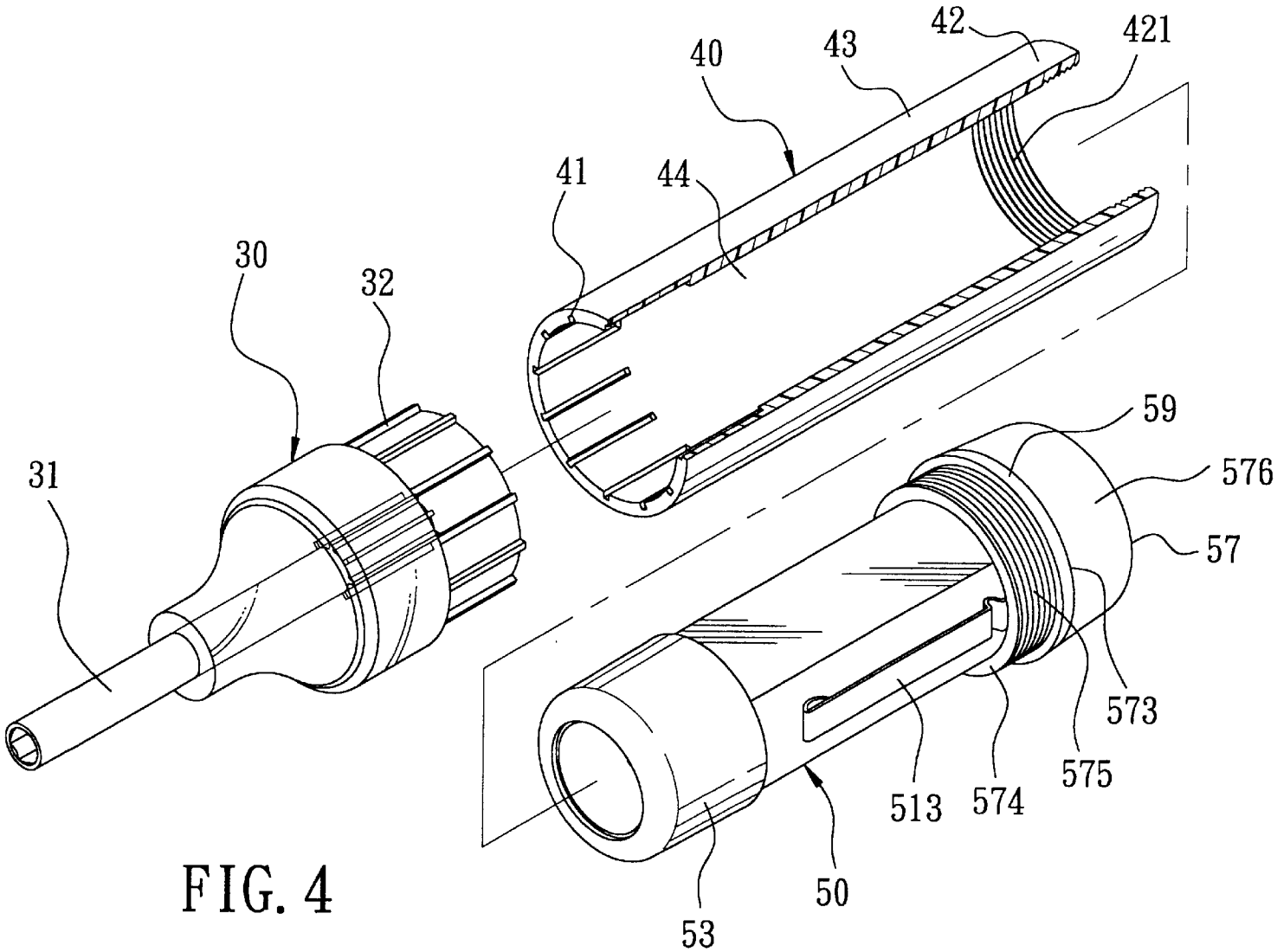
FIG. 4 is an exploded perspective view of a preferred embodiment of the driving tool of the present invention.
Figure 5:
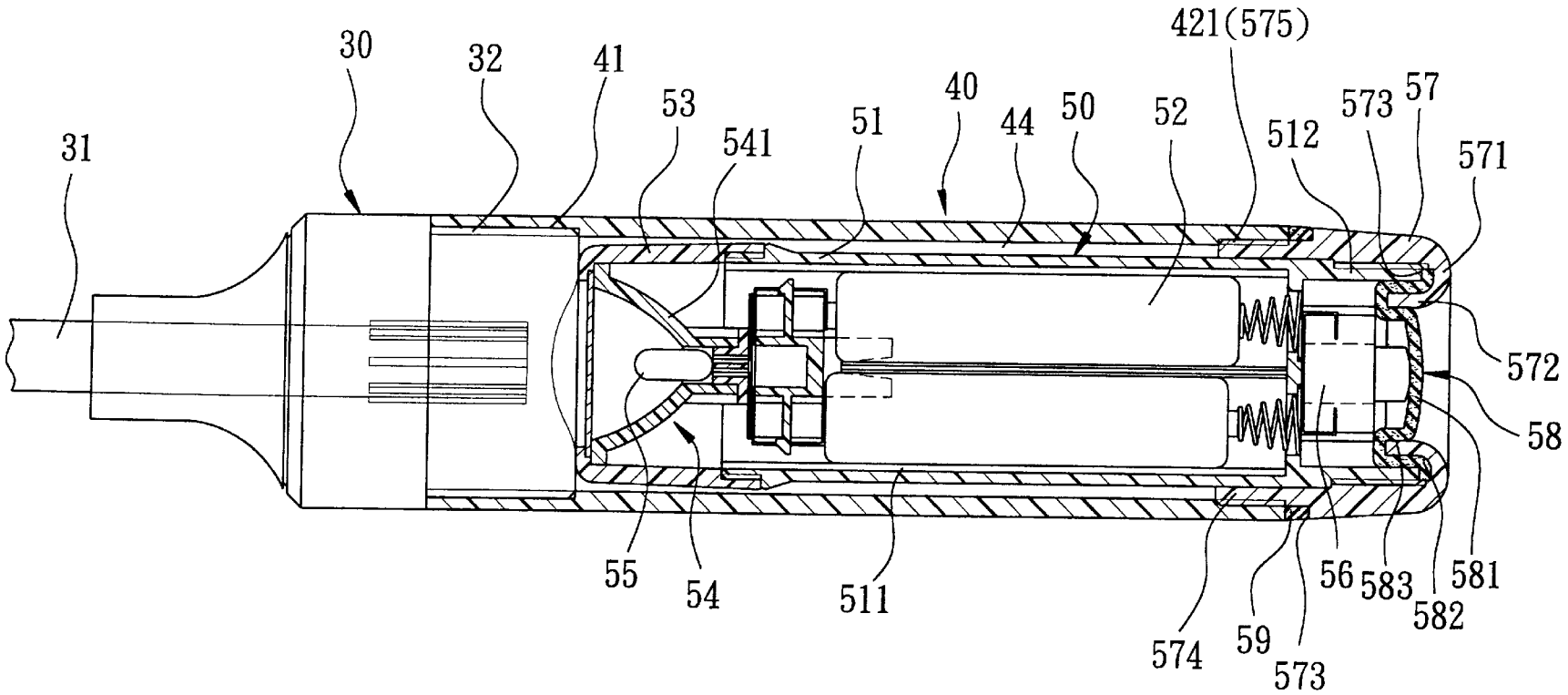
FIG. 5 is a sectional view of the preferred embodiment.

Referring to FIGS. 4 and 5, the preferred embodiment of the driving tool of the present invention is shown to include a handle 40, a drive shaft 31, and a torch 50.

The handle 40 has a tubular outer casing 43, and a transparent front cap 30 mounted on a front end portion of the outer casing 43. The front cap 30 has a cylindrical rear portion formed with a plurality of axially extending ribs 32. The front end portion of the outer casing 43 has an inner surface formed with a plurality of axially extending grooves 41 for engaging the ribs 32. The front cap 30 is mounted securely on the outer casing 43 by means of known high-frequency welding techniques so as to be integral with the outer casing 43 and so as to establish a watertight seal between the front cap 30 and the outer casing 43. The outer casing 43 confines a receiving chamber 44, and has a rear end portion 42 formed with an internal screw thread 421.

The drive shaft 31 is mounted fixedly on the front cap 30 during injection molding of the front cap 30, and extends forwardly from the front cap 30 for mounting of a tool bit (not shown) thereon.

The torch 50 is received in the receiving chamber 44 of the handle 40, and includes a tubular inner housing 51, a lamp unit 54, a push-button switch member 56, a tubular rear cap 57, a sealing ring 59, and a resilient sealing member 58. The inner housing 51 has a front end portion with a front cover 53 mounted thereon, and a rear end portion 512 with the rear cap 57 mounted securely thereon. The inner housing 51 confines a cell compartment 511 adapted for receiving a cell unit 52 therein. The lamp unit 54 is mounted on the front end portion of the inner housing 51 inside the front cover 53 and proximate to the front cap 30, and includes a bulb 55 and a reflector 541 disposed around the bulb 55. The switch member 56 is disposed inside the inner housing 51, and is mounted in the rear end portion 512 of the inner housing 51 and proximate to the rear cap 57. The switch member 56 is connected electrically to the lamp unit 54, and is operable to control activation of the lamp unit 54.

The rear cap 57 has a front section 574 which extends into the outer casing 43 of the handle 40 via a rear opening of the latter and which is formed with an external screw thread 575 for engaging the internal screw thread 421 on the rear end portion 42 of the outer casing 43. The rear cap 57 further has an open rear section 576 for access to the switch member 56. The rear section 576 has an outer diameter larger than that of the front section 574 so as to form a shoulder 573 between the front and rear sections 574, 576. The sealing ring 59 is sleeved on the front section 574 of the rear cap 57 immediately adjacent to the shoulder 573, and is clamped between an end face of the rear end portion 42 of the outer casing 43 and the shoulder 573 when the rear cap 57 engages threadedly the rear end portion 42 of the outer casing 43 so as to establish a watertight seal between the front section 574 of the rear cap 57 and the outer casing 43 of the handle 40 to prevent entry of water or moisture into the receiving chamber 44 from between the rear cap 57 and the rear end portion 42 of the outer casing 43. The rear section 576 of the rear cap 57 is formed with an annular rim which has a first section 571 that extends radially and inwardly from a rear edge of the rear section 576 of the rear cap 57, and a second section 572 that extends axially and forwardly from the first section 571 and into the inner housing 51. The annular rim cooperates with the rear end portion 512 of the inner housing 51 to define a clamping space 573 therebetween.

The sealing member 58 is made of a resilient material, such as rubber, and is disposed rearwardly of the switch member 56. The sealing member 58 has a circular central portion 581 disposed adjacent to the switch member 56, and a peripheral portion 582 extending into the clamping space 573 so as to be clamped between the annular rim of the rear cap 57 and the rear end portion 512 of the inner housing 51. The sealing member 58 has a rear side formed with an annular engaging groove 583 between the central portion 581 and the peripheral portion 582. The second section 572 of the annular rim of the rear cap 57 extends fittingly into the engaging groove 583 for engaging the sealing member 58. The sealing member 58 is thus sealingly retained at the rear section 576 of the rear cap 57 to establish a watertight seal between the rear section 576 of the rear cap 57 and the inner housing 51.

With the provision of the sealing ring 59 and the sealing member 58, water and moisture can be prevented from entering into the receiving space 44 and the cell compartment 511, thereby ensuring the illuminating capability of the driving tool even when the latter is used in water or under very humid circumstances.

Figure 6:
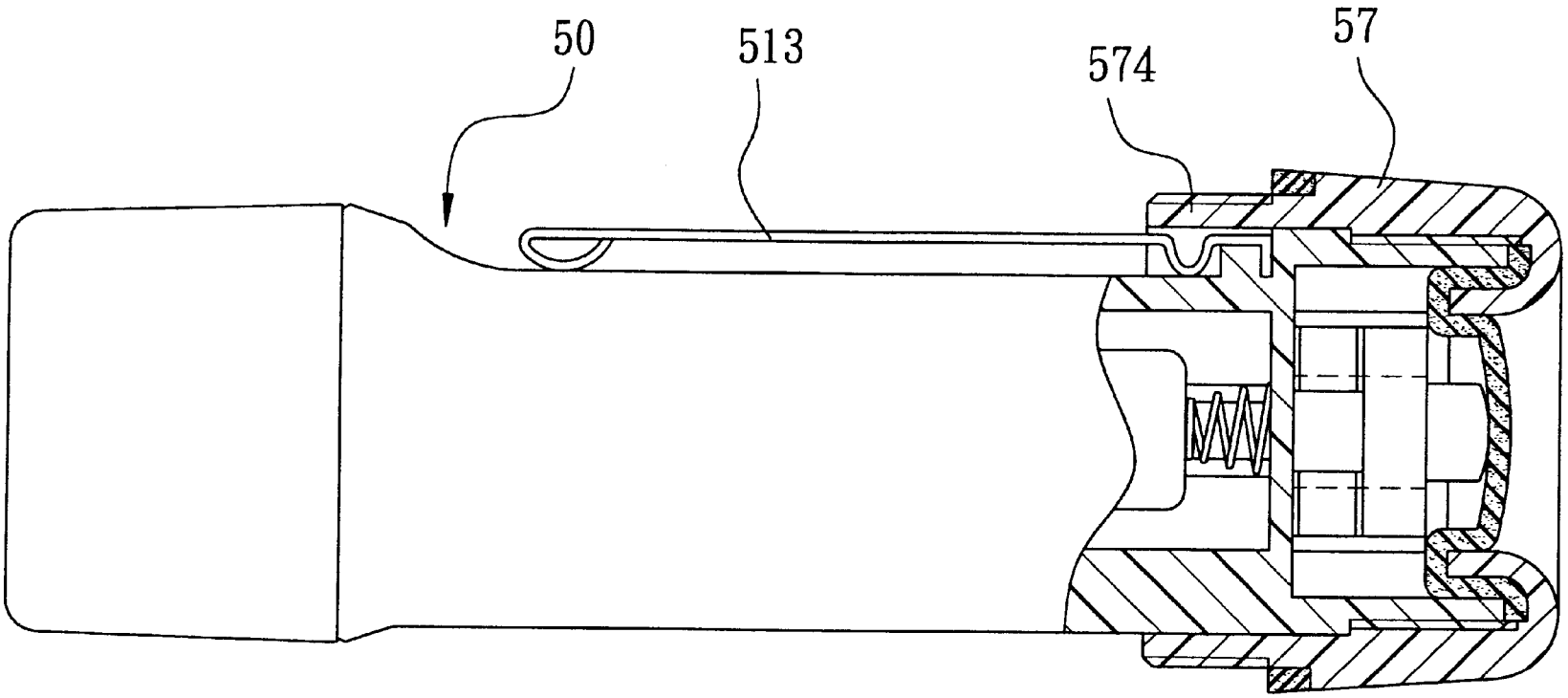
FIG. 6 is a partly sectional view of a torch of the driving tool of the preferred embodiment.

Referring to FIGS. 4 and 6, to use the torch 50 separately, the torch 50 is threaded out of the outer casing 43 of the handle 40 to disengage the external screw thread 575 of the rear cap 57 from the internal screw thread 421 of the rear end portion 42 of the outer casing 43. The inner housing 51 has an outer surface provided with a clip 513 such that the torch 50 can be hooked on a pocket of the user to facilitate carrying of the same.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A driving tool comprising:

a handle having a tubular outer casing with front and rear end portions, and a transparent front cap mounted integrally and securely on said front end portion of said outer casing so as to establish a watertight seal therewith, said outer casing confining a receiving chamber with a rear opening, said rear end portion of said outer casing being formed with an internal screw thread;

a drive shaft mounted on said front cap and extending forward therefrom; and a torch received removably in said receiving chamber of said handle, said torch including a tubular inner housing having a front end portion and a rear end portion, a lamp unit mounted in said inner housing at said front end portion of said inner housing, a push-button switch member mounted on said rear end portion of said inner housing and associated operably with said lamp unit to control activation of said lamp unit, a tubular rear cap mounted securely on said rear end portion of said inner housing, said rear cap having an externally threaded front section which extends into said outer casing of said handle via said rear opening for engaging threadedly the rear end portion of said outer casing, and an open rear section for access to said switch member, wherein said rear section of said rear cap is formed with an annular rim which has a first section that extends radially and inwardly from said rear section, and a second section that extends axially and forward from said first section into said inner housing of said torch, said annular rim cooperating with said rear end portion of said inner housing of said torch to form a clamping space therebetween, said peripheral portion of said sealing member extending into said clamping space so as to be clamped between said annular rim and said rear end portion of said inner housing, said sealing member having a rear side formed with an annular engaging groove around said central portion, said second section of said annular rim extending fittingly into said engaging groove of said sealing member a sealing ring provided on said rear cap to establish a watertight seal between said rear cap and said inner housing, and a resilient sealing member disposed rearwardly of said switch member, said sealing member having a central portion disposed adjacent to said switch member, and a peripheral portion sealingly retained at said rear section of said rear cap to establish a watertight seal between said rear cap and said inner housing, said central portion of said sealing member being depressible to permit actuation of said switch member.

2. The driving tool according to claim 1, wherein said front cap has a cylindrical rear portion with an outer surface formed with a plurality of axially extending ribs, said front end portion of said outer casing being formed with a plurality of axially extending grooves for engaging said ribs.

3. The driving tool according to claim 2, wherein said rear portion of said front cap is connected to said front end portion of said outer casing by high-frequency welding.

4. The driving tool according to claim 1, wherein said inner housing of said torch has an outer surface provided with a clip.

* * * * *